US010043497B2

(12) United States Patent
Ragav

(10) Patent No.: US 10,043,497 B2
(45) Date of Patent: Aug. 7, 2018

(54) MECHANICAL FOUR-MALLET REVOLUTION

(71) Applicant: Nikil Ragav, Sugar Land, TX (US)

(72) Inventor: Nikil Ragav, Sugar Land, TX (US)

(73) Assignee: Nikil Ragav, Sugar Land, TX (US)

( * ) Notice: Subject to any disclaimer, the term of this patent is extended or adjusted under 35 U.S.C. 154(b) by 0 days.

(21) Appl. No.: 14/318,379

(22) Filed: Jun. 27, 2014

(65) Prior Publication Data

US 2015/0379972 A1 Dec. 31, 2015

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
CPC ..... G10D 13/003
USPC ..... 84/402, 411 R, 422.1–422.4, 453
See application file for complete search history.

(56) References Cited

U.S. PATENT DOCUMENTS

| | | | | |
|---|---|---|---|---|
| 1,761,245 | A | 6/1930 | Vitto | |
| 1,876,870 | A | 9/1932 | Dollhopf | |
| 2,905,043 | A * | 9/1959 | Soderberg | G10D 13/003 84/404 |
| 3,150,555 | A * | 9/1964 | Sage | G10D 13/003 84/422.4 |
| 3,460,424 | A | 8/1969 | Tepper | |
| 3,465,635 | A | 9/1969 | Maldacker | |
| 4,651,617 | A * | 3/1987 | Schwartz | G10D 13/003 84/422.4 |
| 8,895,828 | B1 * | 11/2014 | Barlow | G10D 13/003 84/402 |
| 8,946,530 | B1 * | 2/2015 | Karapetyan | G10D 13/06 84/402 |

* cited by examiner

*Primary Examiner* — Jianchun Qin

(57) ABSTRACT

This product is a new invention designed to make four- and multi-mallet percussion both easier and more ergonomically safe. It incorporates various drawings of the invention and its revisions as well techniques and methods for use by percussionists. The mallet device includes various models of the design—all basically including the shaft for holding, holders to place mallets in, and an apparatus for widening and decreasing intervals between the mallets.

4 Claims, 6 Drawing Sheets

MECHANICAL FOUR-MALLET REVOLUTION

CROSS-REFERENCE TO RELATED PATENT APPLICATIONS

N/A

BACKGROUND OF THE INVENTION

This invention relates to percussion, specifically mallet percussion, and most specifically, four-mallet percussion. The invention aims to create a whole new, revolutionary way to play four-mallet percussion.

Mallet Percussion generally includes marimbas, xylophones and vibraphones, aka keyboard instruments. These instruments are made up of bars of various materials including Honduran Rosewood, Paduk wood, synthetic, often fiberglass- and/or polymer-based materials, etc. produce pitched sounds when struck with a mallet. These instruments come in various different sizes: this is due to many keyboard instruments having graduated bars where the lower range of bars are both wider and longer than higher-pitched ones. Also, some instruments have more octaves of bars and/or have wider bars than others.

When first learning how to play this type of instruments, percussionists wield only one mallet per hand. Songs are not meant to be overly complicated with blocks of chords or otherwise. If more pitches are needed at the same time, multiple percussionists can play at the same time. However, this is not ideal when a group has only one percussionist or one keyboard instrument, as both can be quite expensive.

As a solution, various techniques for wielding a total of four mallets (two in each hand) have been proposed and adopted by members of the percussion society. Popular methods include the Stevens Grip and Burton Grip. Stevens Grip is mostly popular with marimbists whilst Burton is more popular amongst vibraphonists.

The following paragraphs refer to certain videos and articles. The video series, "Gary Burton Vibraphone Masterclass," from Vic Firth.com will be herein referred to as (Burton). The video series, "Video Lesson Series with Giff Howarth," from Vic Firth.com will herein be referred to as (Howarth). The video series, "Ney Rosauro: Extended Grip Lesson Series," also from Vic Firth.com is also referred to in the following paragraphs. Comments made by percussion instructor Daniel Vega are referred to as (Vega).

In Stevens Grip, one mallet is held with the pinky and ring fingers quite near the end of the mallet. The other mallet's end pivots between the palm near the flesh part near the thumb and the middle finger in what Giff Howarth considers the "Spiderman webbing" motion (Howarth). This mallet's fulcrum is formed by the thumb and ring finger. The hand should be in a "hand shake" position (Howarth). Like with all percussion techniques, muscles should always remain relaxed while playing to prevent lock-ups of muscles, injuries, etc. However, this fact is quite perplexing and paradoxical in Stevens grip because of the obscure muscles required to use the grip. A "piston stroke" is formed by rotating the wrist to strike individual mallets and a "down-up" stroke should be used to play with both mallets in hand in unison (Howarth). Although this grip allows great flexibility in terms of the ability to reach wide intervals (spaces between keys Ex. C to the E above an octave is a $3^{rd}$ 8 va) and the freedom to use the individual mallets, Stevens grip is not very good for playing loudly and conjuring up enough force to do so. This is because the muscles employed in Stevens Grip are not very naturally used and must be constantly worked at with various exercises to maintain proper technique and avoid short-term injuries. However, many years of playing with Stevens Grip has shown that it can lead to arthritis or tendonitis because of the stress on those muscles as it did with professional Ney Rosauro (Rosauro). Damage can be even worse for people who play this grip incorrectly, especially those just starting off with their four-mallet career (Howarth).

Stevens Grip, because of its use of peculiar muscle groups, is also very difficult for new learners to pick up and learn right away. It requires tons of practice and patience and there is still no guarantee that all percussionists will be able to correctly play with this technique.

On the other end of the spectrum, however, Burton Grip is supposed to be much easier to learn and feel much more natural. Burton Grip, being designed for the Vibraphone by vibraphonist Gary Burton, is much sturdier on account for needing much more force to hit metal bars, often loudly. The mallets are held in the hand, "palms down to the floor", and form a crisscross of sorts (Burton). This grip style still presents its own problems however. For one, intervals cannot be made nearly as wide as Stevens, the individual mallets have much less freedom and control, and roll also cannot be made agreeably, something that Stevens does arguably very well. Also, with Burton Grip comes a clicking noise when the mallets hit the instruments. This occurs because the two mallets hit each other at the point where they cross in the hand. At first, this may seem like a minor annoyance, however clicking noises give the appearance that the percussionist does not maintain his or her equipment well and can deter from the musicians' actual ability when performing.

These reasons are why the aforementioned Ney Rosauro was compelled to create his own grip, the extended-cross grip that attempts to alleviate all the problems by combining elements of both and also attempts to keep the whole thing natural. His grip is a kind of adaptation to Burton because it also follows the pattern of crossing the mallet shafts in the hand. However, it also borrows from Stevens and regular two-mallet playing where one mallet is held using the thumb and index finger as fulcrum while the ring finger holds it to the palm. The pinky finger acts as a buffer to prevent clicking. Rosauro's Extended Cross Grip allows a range of play approximately as wide as Stevens, good stability, individual mallet freedom, and it feels arguably the "most natural" (Vega) of all the grips so it is easy for students to pick up and learn right away. However, like all other four-mallet grips, it is still awkward to stick two mallets in each hand. One significant detail that is clearly evident with the relatively recent development of Rosauro's grip is that the four-mallet and multi-mallet industry or style of play is still very much in its infancy and is still awaiting the best solution.

BRIEF SUMMARY OF THE INVENTION

This invention provides an alternative solution for wielding four or more mallets for multi-mallet play that is meant to be easy and natural while also providing extended function. The instrument is composed of a single shaft that the percussionist holds, one in each hand, which has an apparatus contained in it to hold at least two mallets at once. It is also the object of the invention to allow the interval between the two mallets to be changed by the percussionist with the movement of the percussionist's thumb. The system is designed to be easy to learn and intuitive to play music with.

BRIEF DESCRIPTION OF THE DRAWINGS

The thorough workings of the apparatus can be comprehended more clearly and in greater detail with the detailed descriptions of the accompanying drawings.

DETAILED DESCRIPTION OF THE INVENTION

"Percussionists always want to and aim to create a piano-like experience on keyboard [mallet] instruments" (Vega). This device will help percussionists achieve that goal as it will allow the possibility of wielding four (one device in each hand), six (one device and one standalone mallet in each hand), or even eight mallets (two devices in each hand as if one was using the devices instead of standalone mallets), for example. The invented device can be used in conjunction with existing grip techniques such as Stevens or something entirely different to wield more than four mallets total. This can be accomplished without any injury because the extra mallet(s) can be held in place with minimal movement provided simply to play block chords or can play a note separately.

It is an object of this invention that any mallet can be used with this device, thereby not limiting the percussionists' choice of various sounds and tones. This as well prevents percussionists from having to cut mallets or buy separate mallets just for use in the device. This means that even new, unique mallets such as the one described in U.S. Pat. No. 4,307,647 can be used with this device as well.

Figure 1:
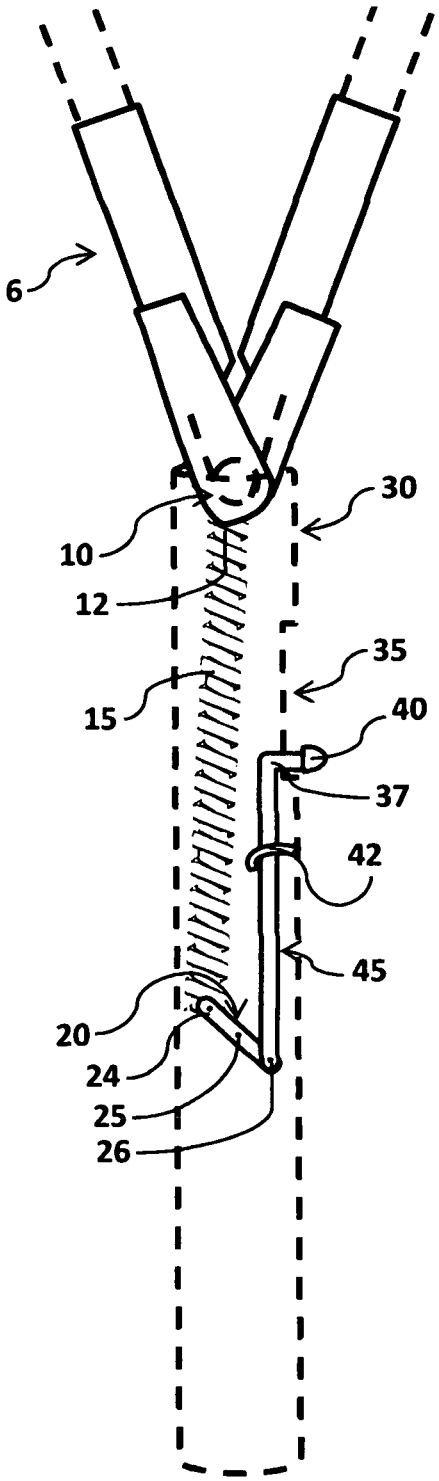
FIG. 1 is a plan view of a first embodiment of the invention.
Figure 2:
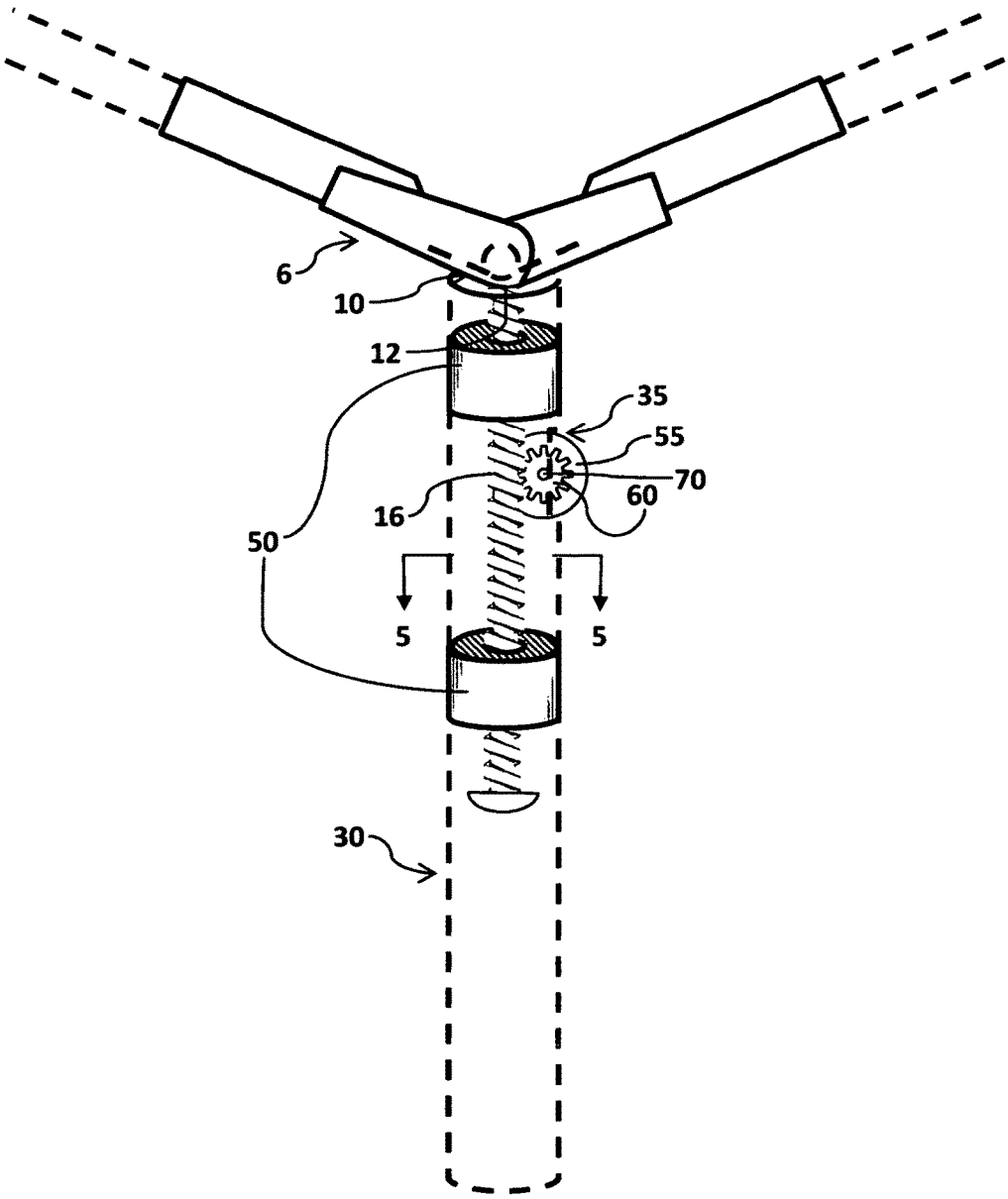
FIG. 2 is a plan view of a second embodiment of the invention.

The drawings feature four [4] embodiments of this invention; these are of course not the only embodiments. Referring initially to FIGS. 1 and 2, the general assembly and operation of the embodiments depicted include a single shaft 30 (shown in phantom) in which most of the components of the invention are housed. Shaft 30 is held by the percussionist. The invented device includes a control means by which said percussionist can adjust the distance between the heads of the mallets which have been inserted into a mallet-holding fixture 6, thus allowing the percussionist to play different intervals for block chords and separate notes for melodies. In the four embodiments depicted in the Figures, mallet-holding fixture 6 is made to move along the long axis of shaft 30, upon input from the percussionist via a control mechanism. As mallet-holding fixture 6 moves out of the Shaft 30, the torque applied on it by the shaft decreases, thus a spring 10 (shown in phantom) in holding fixture 6 expands, and the mallets separate. As mallet-holding fixture 6 moves into the shaft, the torque applied on it by shaft 30 increases, thus spring 10 in mallet-holding fixture 6 compresses, and the mallets move closer together.

Figure 3:
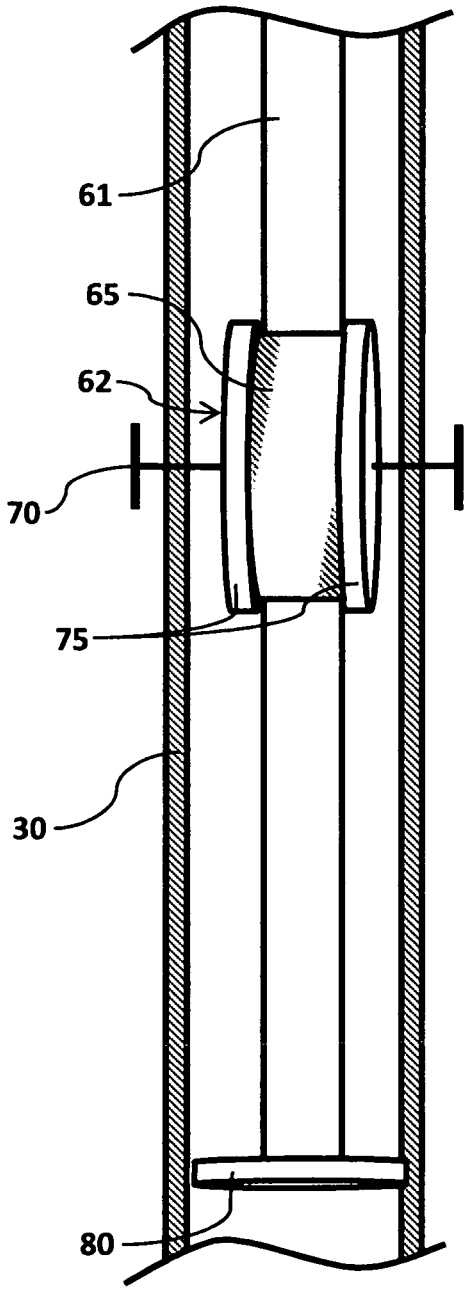
FIG. 3 is an enlarged view of the Control mechanism of a third embodiment of the invention used in place of the gear and screw fixture shown in FIG. 2.
Figure 4:
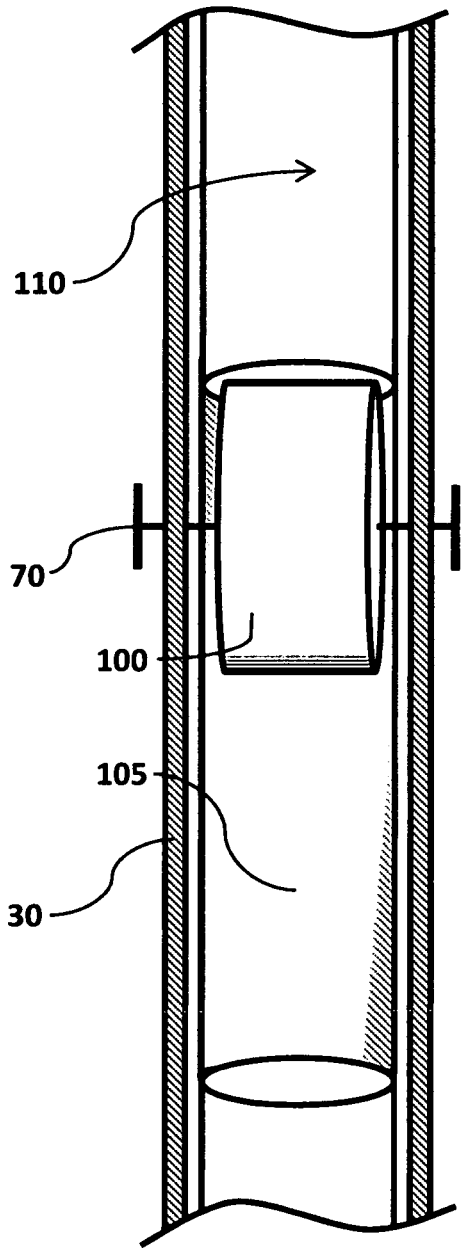
FIG. 4 is an enlarged view of the Control mechanism of a fourth embodiment of the invention used in place of the gear and screw fixture shown in FIG. 2.

As previously mentioned, there are four of many embodiments of this invention featured in the drawings, one utilizing an internal pivot system and detailed in FIG. 1, one utilizing a gear system and detailed in FIG. 2, a revised version of the second embodiment utilizing a wheel system which is depicted in FIG. 3, and another revision utilizing a different wheel system which is depicted in FIG. 4. The second, third, and fourth embodiments featured are very versatile because of their extremely wide range all the way from intervals of seconds to more than two octaves, a range of play that cannot nearly be produced simply by mere hands. The shaft and spacers in the second, third, and fourth are the same; the difference is in the Control mechanism.

Figure 6:
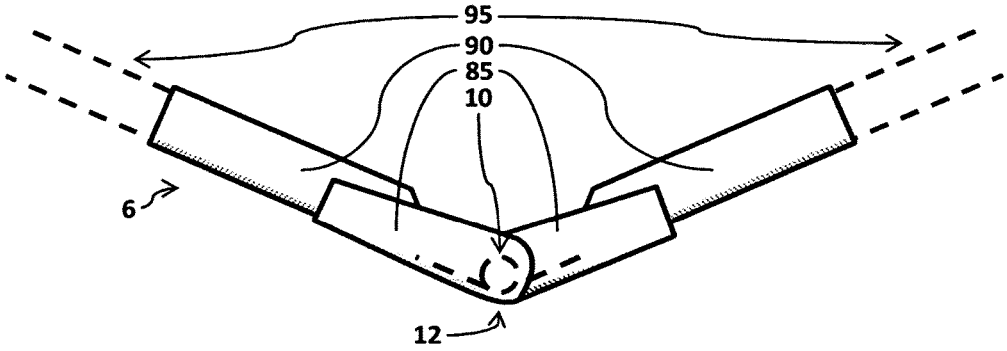
FIG. 6 is an enlarged view of the mallet-holding fixture of the embodiments of the invention shown in FIG. 1 and FIG. 2.

Referring briefly to FIG. 6, an essential part of all the embodiments presented in the figures, the mallet-holding fixture 6 is comprised of slots 90, connecting pieces 85, a spring 10 that can expand and compress to change the angle between slots 90, and a junction point 12 where the Control mechanism attaches to mallet-holding fixture 6. Slots 90 preferably can hold virtually any mallets, meaning said slots 90 have a tolerance for a fairly wide range of materials and diameters of mallet shafts 95 (shown in phantom). The shape of slots 90 is optimally angled to allow for both very wide and very narrow intervals between the mallets.

In the first and second embodiments of the invention depicted in FIGS. 1 and 2 respectively, mallet-holding fixture 6 is created by an anchor bolt and two sleeve anchors, serving as slots 90, which have been epoxied into the anchor bolt. The anchor bolt serves as connecting pieces 85, holds spring 10, and has a threaded hole for unction point 12. Spring element 10 allows mallet-holding fixture 6 to expand and contract, thus allowing the mallets placed in mallet-holding fixture 6 to play intervals of seconds (two adjacent notes) to around two octaves. This mallet-holding fixture 6 element of the invention can be streamlined into a single, sturdy piece through molding, 3D printing, or other manufacturing techniques for future embodiments of the invention.

FIG. 1 depicts a first embodiment of the invention, which uses an internal lever-pivoting control mechanism to transfer the percussionist's input to change the interval between the mallets placed in the device in a natural, ergonomic manner. The control mechanism of said first embodiment comprises a screw 15, a pivot rod 20, multiple pivot points 24, 25, and 26, a control rod 45 with lever part 37, a rubber stopper cap 40, and a binding piece 42. Screw 15 threads screws into and is attached to the anchor bolt of mallet-holding fixture 6 at junction point 12. The head of screw 15 has been removed so that it better fits in shaft 30 and does not obstruct pivot rod 20 from rotating fully.

Screw 15 is fastened to pivot rod 20 at pivot point 24. Control rod 45 is fastened to pivot rod 20 at pivot point 26. pivot rod 20 is slightly shorter than the inside diameter of shaft 30. Pivot rod 20 rotates around the central pivot point 25, which is formed by a nail passing through shaft 30. Thus, when force is applied to move lever part 37 downwards (as drawn), screw 15 moves upwards, which pushes mallet-holding fixture 6 out of shaft 30 so that mallet-holding fixture 6 can expand and widen the angle between the mallet heads. Pivot points 24, 25, and 26 allow screw 15 and control rod 45 to move up and down freely because pivot rod 20 can freely rotate about pivot point 25.

The elements of the control mechanism described above are housed in shaft 30. Length, diameter, and thickness of shaft 30 can be adjusted as necessary. In the first and second embodiments of the invention, the shaft member was made out of PVC, but it can be molded out of other plastics, metals, or even other materials for other embodiments.

A slit 35 is cut into the side of shaft 30. In both the first and second embodiments of the invention, slit 35 is about 1 inch long along the length of shaft 30 and is placed naturally where the thumb falls when the percussionist grips the shaft.

Control rod 45, which is fastened to the Pivot rod 20 via pivot point 25 and constrained to move only parallel to the length of the Shaft 30 by binding piece 42, juts out from slit 35 and forms an "L" shape to create lever piece 37. It is capped by rubber stopper cap 40 so that the thumb of the percussionist can comfortably move lever 37 up and down. Said percussionist interacts with control rod 45 to cause mallet-holding fixture 6 to move in and out of shaft 30, thereby narrowing and widening respectively the interval between the mallet heads placed in said mallet-holding fixture 6.

FIG. 2 depicts a second embodiment of the invention, in which, unlike in FIG. 1, a screw element 16 is parallel to the length of shaft 30. Stoppers 50, each with a hole through its center, align screw 16 within shaft 30. Stoppers 50 can be rubber cylindrical stoppers with a hole drilled through, could be molded, or made of other materials. It can even be fused to or manufactured directly as part of shaft 30. A thumb wheel 55 having a coaxially mounted gear 60 is pivotably mounted to the wall of shaft 30 so that gear 60 engages screw 16 inside shaft 30 one side of wheel 55 extends outward through the wall of shaft 30.

Still referring to FIG. 2, as the user turns thumb wheel 55, gear 60 also rotates. Gear 60 engages screw element 16, turning rotational motion into vertical (as drawn) motion. Screw element 16 has its head attached so that its movement toward fixture 6 can be limited as desired when it hits the bottom stopper 50. The other end of screw 16 is attached to mallet-holding fixture 6 at junction point 12. The lower limit of the angle between the mallets is determined by how far mallet-holding fixture 6 fits in shaft 30, which can be limited by the placement of the upper stopper 50.

Both thumb wheel 55 and gear 60 are mounted and secured into the shaft 30 by an axle 70. The placement of axle 70 is such that gear 60 can thread into screw 16 and such that thumb wheel 55 slightly juts out of the slit 35 in shaft 30 so that the percussionist can rotate it and cause screw 16 to move up and down, expanding and compressing respectively spring 10 within mallet-holding fixture 6. Thumb wheel 55 and gear 60 can be attached or even made as a single piece. thumb wheel 55 may or may not have teeth.

Referring now to FIG. 3, a third embodiment of the invention replaces thumb wheel 55, gear 60, and screw 16 control mechanism with a wheel 62 having extruded/raised edges 75 and an indented portion 65 that rolls against a smooth rod 61. The third embodiment's control mechanism is depicted in FIG. 3. As in the first and second embodiments but not shown in FIG. 3, the control mechanism attaches to mallet-holding fixture 6 found in FIGS. 1, 2, and 6 at a junction point 12. In the embodiment of FIG. 3, wheel 62 is mounted in place of thumb wheel 55 and gear 60 on axle 70. Wheel 62 also juts out from slit 35 in shaft 30 (not shown in FIG. 3) so that the percussionist can rotate it and cause the motion of mallet-holding fixture 6. In the embodiment of FIG. 2, the user rotates thumb wheel 55, which is attached to gear 60, which causes screw 16 to move relative to shaft 30. In the embodiment of FIG. 3, the user directly rotates wheel 62, which causes movement of smooth rod 61 relative to shaft 30. smooth rod 61 can be sprayed or coated with rubber cement or similar material with the purpose of inducing friction, allowing the wheel to roll along its surface. Indented portion 65 of wheel 62 can also be sprayed with a rubber cement or other friction-inducing substance. The extruded/raised edges 75 of wheel 62 act as guides to ensure the movement of the Smooth rod 61 is constrained in only the single desired axis. Flat head 80 is used to restrict the range of motion.

Referring now to FIG. 4, a fourth embodiment of the invention replaces the previous control mechanisms with a smooth wheel 100 that rolls against an indent 105 in an indented rod 110. As in the first and second embodiments, the control mechanism attaches to mallet-holding fixture 6 shown in FIGS. 1, 2, and 6 at junction point 12. Smooth wheel 100 is mounted in place of thumb wheel 55 and gear 60 on axle 70. Smooth wheel 100 also extends out through slit 35 in shaft 30 so that the percussionist can rotate wheel 100 and thereby adjust mallet-holding fixture 6. As in the third embodiment, the user directly rotates the part, wheel 100, to cause the movement of rod 110. Both smooth wheel 100 and indent 105 in indented rod 110 can be sprayed or coated with rubber cement or similar material with the purpose of inducing friction, allowing smooth wheel 100 to roll along the surface of indent 105 without slipping. The length of indent 105 determines the interval range of the device; thus, the range of motion of indented rod 110 is determined and restricted by indent 105.

Figure 5:
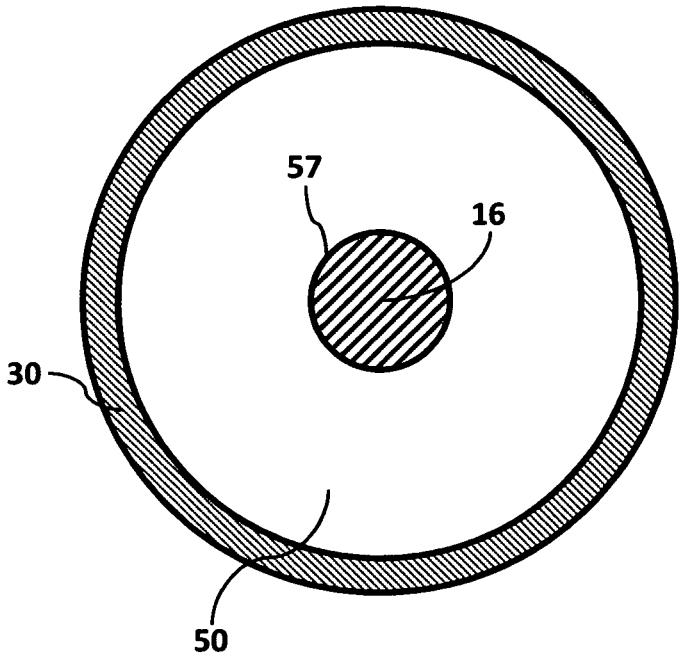
FIG. 5 is a cross-section of the shaft element of the embodiment of the invention shown in FIG. 2 taken in the direction of arrows 5.

The second, third, and fourth embodiments of the invention include a stopper system 50 within the shaft. FIG. 5 is a cross-section of shaft 30 showing stopper 50. Screw 16 (from the second embodiment and shown in FIG. 2), smooth rod 61 (from the third embodiment and shown in FIG. 3), or indented rod 110 (from the fourth embodiment and shown in FIG. 4) fit through hole 57 in stoppers 50 in their respective embodiments. The stopper system is used in order to keep screw 16, smooth rod 61, or indented rod 110 aligned inside the shaft. In other words, the system restrains the motion of screw 16, smooth rod 61, or indented rod 110 in their respective embodiments, preventing any lateral motion while allowing the piece that fits through the center hole to move without obstruction linearly through the Shaft 30. Stopper 50 essentially acts as a spacer within the shaft. The whole stopper 50 and shaft 30 fixture could be made as a single part through injection molding or 3D printing, for example, when mass produced. If each part is made separately, then each part could even be made of different materials; for example, the stopper 50 could be made of a rubber stopper and glued into a PVC shaft 30. A single conjoined piece can be made out of all the same material, such as PVC or similar plastics, metal, wood, or something else entirely.

What is claimed is:

1. An apparatus for facilitating multi-mallet percussion by a percussionist, comprising:

a shaft;

means for receiving and holding at least two mallets such that said mallets extend from one end of said shaft; and control means for widening and narrowing the interval between the mallet heads, said control means being attached to said shaft at a location between the ends of the shaft and being actuable by the application of a force tangential to the outside surface of the shaft by the percussionist, whereby the control means can be actuated by the percussionist without requiring the use of a hand other than the hand holding the apparatus and without requiring the percussionist to release the shaft;

wherein said holding means comprises a spring-loaded member having at least two mallet holders, said spring-loaded member tending to urge said mallet holders apart, said spring-loaded member being mounted at one end of said shaft and moveable in and out of said shaft, such that moving said spring-loaded member into said shaft changes the angle between said holders.

2. The apparatus of claim 1 wherein said control means is actuable by a thumb of the percussionist.

3. The apparatus of claim 1 wherein said control means is actuable by a finger of the percussionist.

4. The apparatus of claim 1 wherein said means for receiving and holding mallets is mounted on one end of said shaft such that said mallets define an angle therebetween and wherein said control means widens and narrows the interval between the mallet heads by adjusting said holding means so as to adjust said angle.

* * * * *